US008497749B2

(12) United States Patent
Elmore

(10) Patent No.: US 8,497,749 B2
(45) **Date of Patent: *Jul. 30, 2013**

(54) SINGLE CONDUCTOR SURFACE WAVE TRANSMISSION LINE SYSTEM FOR TERMINATING E FIELD LINES AT POINTS ALONG THE SINGLE CONDUCTOR

(75) Inventor: Glenn E. Elmore, Santa Rosa, CA (US)

(73) Assignee: Corridor Systems, Inc., Santa Rosa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/510,197

(22) Filed: Jul. 27, 2009

(65) Prior Publication Data

US 2009/0284435 A1 Nov. 19, 2009

Related U.S. Application Data

(63) Continuation of application No. 12/123,413, filed on May 19, 2008, now Pat. No. 7,567,154, and a continuation-in-part of application No. 11/134,016, filed on May 20, 2005, now abandoned.

(60) Provisional application No. 60/573,531, filed on May 21, 2004, provisional application No. 60/576,354, filed on Jun. 1, 2004.

(51) Int. Cl.
*H01P 3/10* (2006.01)

(52) U.S. Cl.
USPC ..... 333/240; 333/21 R; 333/34

(58) Field of Classification Search
USPC ..... 333/240, 21 R, 34, 236, 245; 379/55.1; 340/310.11, 310.16
See application file for complete search history.

(56) References Cited

U.S. PATENT DOCUMENTS

| | | | | |
|---|---|---|---|---|
| 2,438,795 | A | 3/1948 | Wheeler | |
| 2,737,632 | A | 4/1950 | Grieg | |
| 2,685,068 | A | 7/1954 | Goubau | |
| 2,852,753 | A | 9/1958 | Gent et al. | |
| 3,201,724 | A | 8/1965 | Hafner | |
| 3,509,463 | A | 4/1970 | Watkins et al. | |
| 3,588,754 | A | 6/1971 | Hafner | |
| 3,603,904 | A | 9/1971 | Hafner | |
| 4,278,955 | A | 7/1981 | Lunden | |
| 4,730,172 | A | 3/1988 | Bengeult | |
| 4,743,916 | A | 5/1988 | Bengeult | |
| 6,384,700 | B1 | 5/2002 | Craine et al. | |
| 7,567,154 | B2 * | 7/2009 | Elmore | 333/240 |

OTHER PUBLICATIONS

Akalin, Tahsin, et al., Single-Wire Transmission Lines at Teraherz Frequencies, IEEE Transactions on Microwave Theiory and Techniques, vol. 54, No. 6, Jun. 2006, pp. 2762-2767.

* cited by examiner

*Primary Examiner* — Benny Lee
(74) *Attorney, Agent, or Firm* — Craig M. Stainbrook; Stainbrook & Stainbrook, LLP

(57) ABSTRACT

A low attenuation surface wave transmission line system for launching surface waves on a bare and unconditioned conductor, such as are found in abundance in the power transmission lines of the existing power grids. The conductors within the power grid typically lack dielectric and special conditioning. Accordingly, the present invention includes a first launcher, preferably including a mode converter and an adapter, for receiving an incident wave of electromagnetic energy and propagating a surface wave longitudinally on the power lines. The system includes at least one other launcher, and more likely a number of other launchers, spaced apart from one another along the constellation of transmission lines. The system and associated electric fields along any given conductor are radially and longitudinally symmetrical.

14 Claims, 13 Drawing Sheets

SINGLE CONDUCTOR SURFACE WAVE TRANSMISSION LINE SYSTEM FOR TERMINATING E FIELD LINES AT POINTS ALONG THE SINGLE CONDUCTOR

CROSS REFERENCES TO RELATED APPLICATIONS

The present application is a continuation-in-part of U.S. Utility patent application Ser. No. 12/123,413, filed May 19, 2008 which issued as U.S. Pat. No. 7,567,154, Jul. 28, 2009, and U.S. Utility patent application Ser. No. 11/134,016, filed May 20, 2005 now abandoned, which claims the benefit of the priority date of U.S. Provisional Pat. App. Ser. Nos. 60/573,531, filed May 21, 2004, and 60/576,354, filed Jun. 1, 2004.

SEQUENCE LISTING

Not applicable.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to surface wave transmission systems, and more particularly to a low loss system for launching surface waves over unconditioned lines such as power lines.

2. Detailed Discussion of Related Art

The original mathematical work underlying electromagnetic surface wave theory was done by Maxwell in the second half of the 19$^{th}$ century and is still used today. At the beginning of the 20$^{th}$ century, Sommerfeld and others applied Maxwell's equations to show the possibility of surface waves on a conductor. In the years that followed, further analytical work was done at least as late as in 1941 adding more detail to the theory [*Electromagnetic Theory*, Stratton, McGraw-Hill p. 27]. None of these theoretical treatments showed how to reduce the theory to practice or how to actually launch a surface wave onto a conductor.

In 1948, in U.S. Pat. No. 2,438,795, Wheeler described an "improved waveguide system" related to more efficiently "translating" signals over a single conductor, such as a power line, or terminating currents flowing on a conductor, particularly an end-fed antenna. This involved improving impedance matching and reducing, but not preventing, radiation from the line or antenna.

In 1954, in U.S. Pat. No. 2,685,068 (hereinafter "Goubau '068"), Goubau showed a practical way to launch and maintain a low loss and non-radiating surface wave on a cylindrical conductor. Referring to both Wheeler and Sommerfeld, Goubau posited:

"Sommerfeld's wave on a bare conductor is constrained to the conductor only by reason of the conductor's finite conductivity" [Goubau '068, column 4, line 26.]

Goubau added and developed a new premise.

"[A] surface wave can be transmitted along a conductor independent of its conductivity by reducing the phase velocity of the same. This reduction in phase velocity can be accomplished by suitably modifying the surface of the conductor." [Goubau '068, column 4, line 13.]

Goubau further states:

"Any suitable modification of the conductor, or wire, which reduces the phase velocity of the transmitted wave will enable the conductor to be used as a surface wave guide." [Goubau, column 6, line 61.]

Goubau's surface wave transmission line (SWTL) invention required modification of the conductor in order to reduce the phase velocity of the wave [Goubau '068, column 6, line 61]. Propagation of the wave was initiated onto the conductor by means of a horn launcher [Goubau '068, column 17, line 18].

Goubau taught directly away from the usefulness of uninsulated and unconditioned conductor. He described the potential use of his invention with unmodified conductors and stated:

"Adequate, but less efficient, results for some purposes may be obtained by using a bare, unmodified wire in combination with the launching horn shown in FIGS. 8 and 9. Actually even for a bare conductor there is a microscopically thin dielectric layer present on its surface which tends to concentrate adjacent the conductor the field of the transmitted energy. For frequencies below about 5000 megacycles per second this minute surface layer is insufficient to shrink the radial extent of the field enough to permit the use of a bare conductor with a horn of convenient dimensions. However, at higher frequencies the required thickness of dielectric layer to accomplish a given amount of field concentration is lessened, and use of a bare conductor in combination with a conical horn is feasible. It will be understood that, for any given frequency of the transmitted energy, a considerably larger horn diameter will be required for a bare conductor than for a conductor with modified surface. This is because the shrinkage of the radial extent of the field depends upon the thickness of the dielectric layer on the conductor surface."[Goubau '068, column 19, lines 10-64.]

Goubau described a system utilizing a quarter wave shorted section, a 3.5 inch cylindrical section and a tapered horn of 22 inches axial length for a total length of greater than 64 cm. He detailed performance measured between 1600 MHz and 4700 MHz and indicated that the flare angle (flare half angle of approximately 16 degrees) was too large for best efficiency at 4700 MHz. [Goubau '068, column 17, lines 53-69.]

In the years that followed, there has been a variety of patents issued related to Goubau's SWTL which was dubbed "Goubau Line" or "G-Line" and is commonly referred to as such in his honor. Goubau made further investigations into his SWTL, related to long distance transmission [*Investigation of a Surface-Wave Line for Long Distance Transmission*, Goubau, Sharp, Attwood] and described it in comparison to more traditional lines [Open Wire Lines, Goubau] and described the effects of bends [*Investigations with a Model Surface Wave Transmission Line*, Goubau, Sharp].

By 1964 at least one reference book on electronic and radio theory included descriptions of this SWTL and also referred to it as G-Line [see, *Reference Data for Radio Engineers*, International Telephone & Telegraph, 11$^{th}$ Printing]. There were several applications of G-Line, but the need for insulation or special conditioning of the conductor generally restricted its use to off-beat problems; transmission to a device being towed from an airplane, communications within a mine and other situations where the expense of installing a specially prepared line was merited.

In 1965 U.S. Pat. No. 3,201,724, to Hafner, described use of Goubau line for transmitting information by way of the electric power grid. This described replacing one of the existing power conductors with a special fabricated conductor, wrapped in copper and insulation, which could be used with special supports to allow launchers to be suitably mounted.

More recently, in 2001 a work described a surface wave method for transporting RF over long distances with low loss using a metalized MYLAR® (dielectric) ribbon [*Low-Loss RF Transport Over Long Distances*, Friedman, Fernsler]. This referenced previous work but added no new insight into the possibility of SWTL operating on unconditioned lines. This work indicated that without dielectric the wave extends "impractically far" beyond the conductor. [MYLAR is a registered trademark of E. I. Du Pont De Nemours and Company, of Wilmington, Del., and as used herein the term shall mean biaxially-oriented polyethylene terephthalate (boPET) polyester film.]

None of this previous work has recognized a way to separate wave transmission along a single unconditioned conductor from simultaneously causing radiation from this same conductor. Greater and better use of Goubau's invention has been limited by the need for special treatment of the conductor, most often provided by supplying insulation or a special dielectric coating. His invention required this special modification both in order to maintain a non-radiating transmission line and also to reduce the radial extent of the electric field around the conductor in order to allow the use of a horn launcher of convenient size.

The foregoing patent and prior art references reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

The present invention is a low attenuation SWTL system of the kind disclosed in co-pending U.S. patent application Ser. No. 11/134,016, filed 20 May 2005 [Publication No. US-2005-0258920-A1], now abandoned, which application is incorporated in its entirety by reference herein. The inventive SWTL system uses a single central conductor and a variety of launcher types. It is suitable for launching and transmitting electromagnetic energy over an extremely broad range of frequencies. It greatly improves upon prior SWTL art by removing the requirement for any dielectric or special featuring of the conductor. Low attenuation of the propagated wave together with low radiation are achieved through radial and longitudinal symmetry of the system and of the associated electric fields along the SWTL conductor. These are achievable without requiring any slowing of the propagated wave. This invention also does not require any slowing of the wave in order to allow the launcher which initiates the propagation to be of convenient size.

Furthermore, this invention is not limited to use with a horn type launcher, but rather allows a variety of launcher forms including horn, planar and reverse-horn. Some of these launcher forms can produce a very low attenuation SWTL system across more than three decades of frequency range while being no larger than a few percent of a wavelength at the lowest frequency. Launchers may be further shaped and fitted with dielectric to either minimize, or to augment, conversion to radiating modes at the same time they convert to and from a wave propagation along the SWTL conductor. In this manner antenna functionality may be integrated with the launcher.

Though by no means limited to this use, this invention has particular application to the transport and distribution of high speed information over a three decade frequency range, including most importantly the range of approximately 50 MHz to 20 GHz, and most importantly including the 50 MHz to 5 GHz sub-range. The system employs power transmission lines in the existing worldwide power distribution grid as conductors for surface wave transmissions. In addition to providing information transport and mobile communications access, this invention has particular use as a means for reducing energy costs by providing real time control and monitoring information of end-use energy demands. This kind of real time access is an enabling aspect of "Smart Grid" energy utility systems and can enable economic incentive for end users to reduce their individual energy consumption at times of peak energy demand. There have been estimates of several hundred billion dollars of potential savings in the United States alone achievable through the off-loading of only a few percent of current peak energy usage because doing so removes or reduces the necessity of expanding costly energy generation, transmission and distribution systems.

Other advantages and novel features characteristic of the invention, as to organization and method of operation, together with further objects and advantages thereof will be better understood from the following description considered in connection with the accompanying drawings, in which preferred embodiments of the invention are illustrated by way of example.

It is to be expressly understood, however, that the drawings are for illustration and description only and are not intended as a definition of the limits of the invention. The various features of novelty that characterize the invention are pointed out with particularity in the claims annexed to and forming part of this disclosure. The invention does not reside in any one of these features taken alone, but rather in the particular combination of all of its structures for the functions specified.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
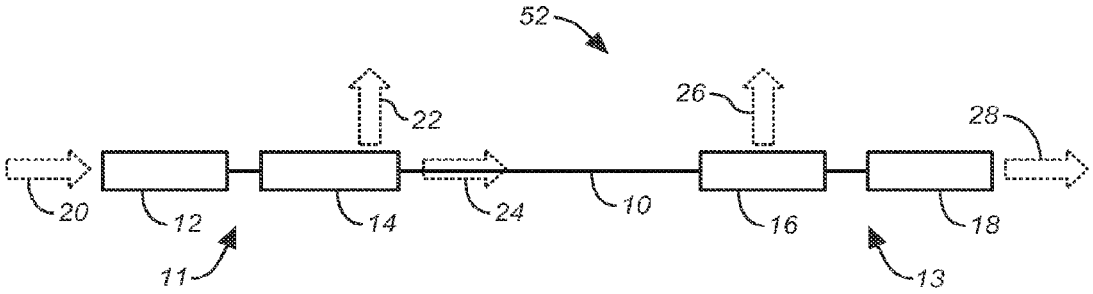
FIG. 1 is a schematic diagram showing wave propagation through and from a SWTL system, which includes a central unconditioned conductor with launchers located at each of its ends.

Referring now to FIGS. 1, 2A, 2B, 3, 4, 5A-5C, 6A, 7A-7C, 8A, 8B, 9A, 9B, 10-13, 14A, and 14B, wherein like reference numerals refer to like components in the various views, there is shown a novel SWTL system for launching surface waves on a single conductor. FIG. 1 is a schematic view showing an embodiment of the present invention, which is a SWTL system comprising a first launcher 11 comprising an adapter 12 and mode converter 14 located at one end of a SWTL central conductor 10 which has its second end connected to a second launcher 13 comprising a second mode converter 16 and second adapter 18. The first and second launchers may be either identical or different in design. Central conductor 10 is shown in each of FIGS. 1, 2A, 3, 5A-5C, 8B, 9A-9B, and 10.

The incident wave 20 may reach the first launcher either by way of propagation through or along a conventional type of transmission line or by radiation through a free space or dielectric medium. The launcher may also provide impedance transformation between the impedance of the incident wave to the impedance of the SWTL as part of its function. The transmitted wave 28 exits the system from the second launcher 13.

Figure 3:
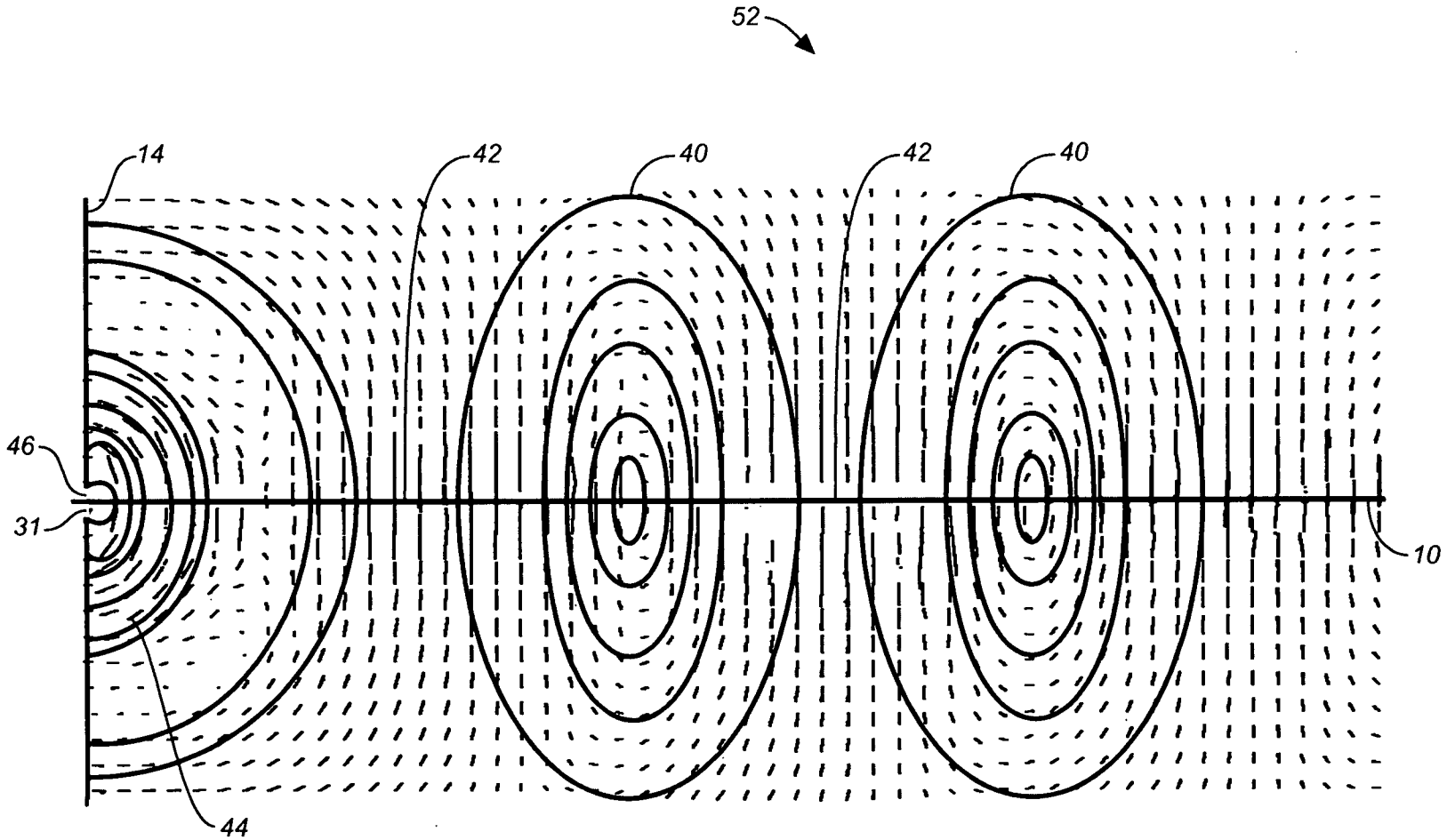
FIG. 3 is a schematic diagram showing electric field lines in the vicinity of a planar mode converter and unconditioned SWTL central conductor, with solid lines highlighting the path of the electric field.

FIG. 3 is a schematic representation of electric field (E-field) lines near an exemplary SWTL system. In this view, the system includes a mode converter 14 and SWTL 10. The mode converter in the example launcher is of a planar type and has a small central hole 46 through which the SWTL central conductor 10 may pass. The entire system may be embedded in an enclosing medium 52, which may be a vacuum, air, or another relatively isotropic dielectric. In regions of the SWTL conductor 10 that are at many line diameters' distance away from the launcher 14, virtually all of the electric field (E-field) lines emanate away from the central conductor at right angles to the conductor, form a loop 40, and terminate at other locations along the same SWTL conductor. Solid lines 44 emphasizing the path of these field lines have been drawn in over the more numerous but shorter lines used to represent the E-field. This representation shows the path of the field lines but does not clearly show the relative magnitude of the fields at any point. The figure depicts a "snapshot" in time and phase for a wave propagating along the SWTL with fields of peak magnitude 42 located between the solid loops 40.

Figure 14A:
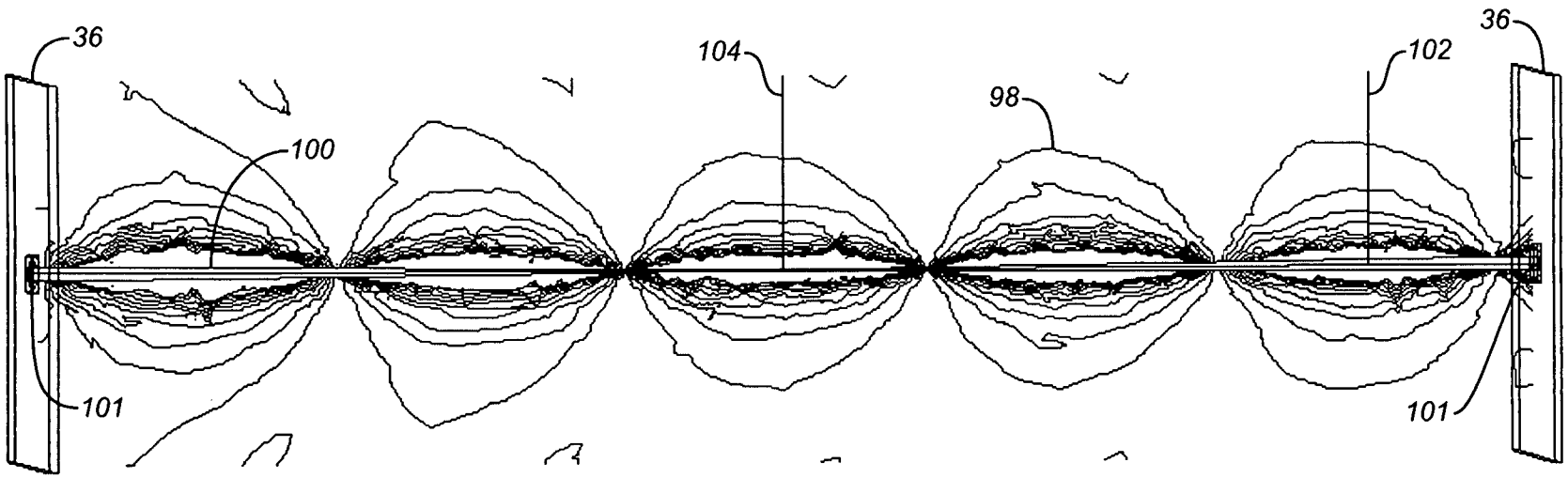
FIG. 14A is a model showing contours of constant electric field magnitude in the vicinity of a planar mode converter and tapered SWTL central conductor of square cross section.

FIG. 14A shows a model of a tapered SWTL central conductor of square cross section 100 between two 100 mm square planar mode converters 36 which also have a central 10 mm square hole 101 through which the SWTL conductor passes. In this model, the SWTL central conductor is 400 mm long and tapers from 4 mm at one end to 0.04 mm at the center and then back to 4 mm at the second end. Also shown in FIG. 14A are contours of constant electric field magnitude 98 of a 1875 MHz wave propagating along the SWTL. As in FIG. 3 this is a "snapshot" in time and phase for the propagating wave. Two different locations along the SWTL are indicated in this figure. These relate to different SWTL conductor sizes.

The first location 104 is at the center of the tapered SWTL central conductor where the conductor is 0.04 mm square. At the second location 102, the conductor is much larger and approximately 3 mm square.

Figure 14B:
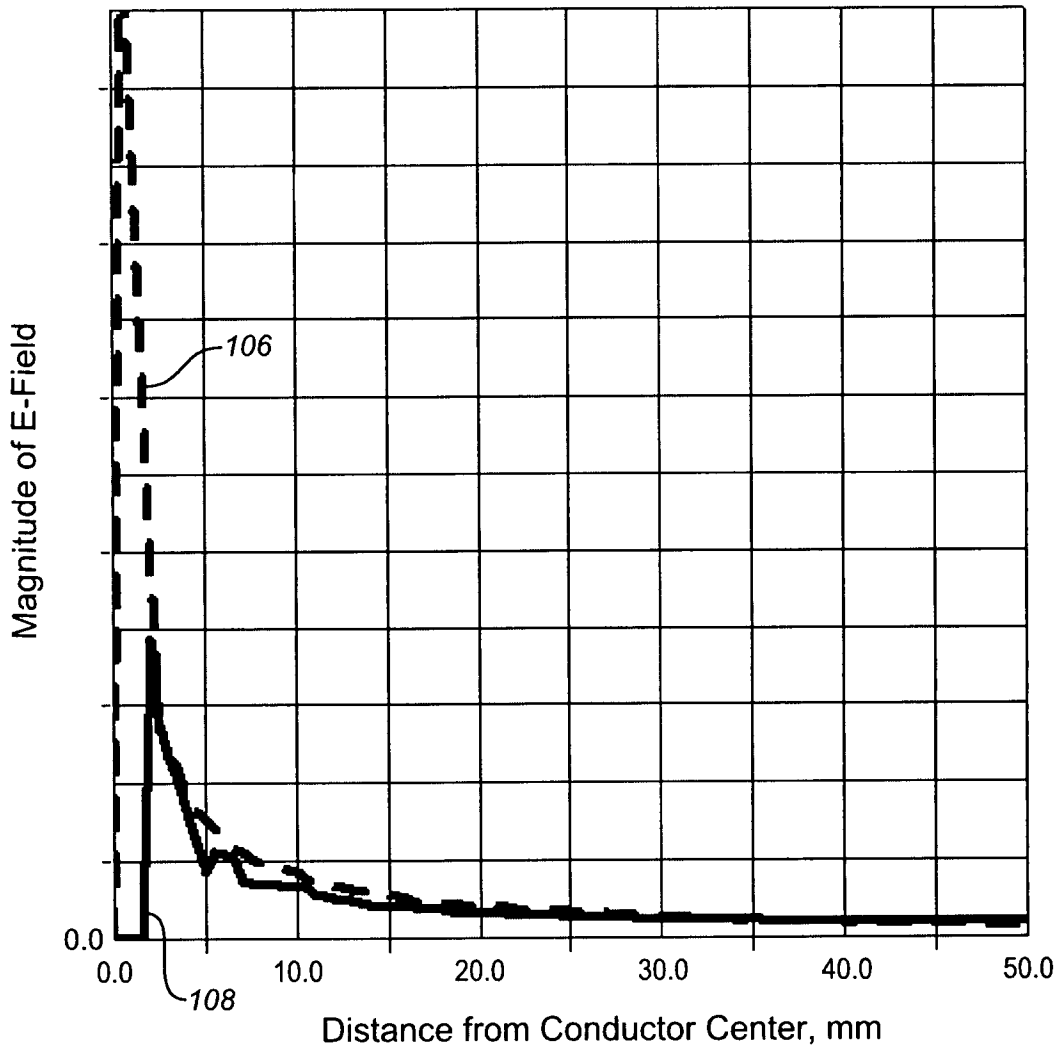
FIG. 14B shows plots of relative electric field magnitude versus distance from a tapered SWTL central conductor of square cross section at two different locations along the taper.

FIG. 14B shows the relative electric field magnitude at these two locations as a function of distance away from the center of the SWTL conductor. The electric field magnitude very close to the SWTL at the location where the tapered line is smallest 106 is significantly greater than the corresponding case where the tapered line is larger 108. However beyond a few mm distance away from the SWTL conductor electric field magnitude is similar for the two cases.

For SWTL conductors made from metal or other highly conductive material, in the absence of an embedding dielectric or magnetic materials near the conductor, the relative propagation velocity of the wave traveling along this SWTL is very nearly unity. In the region far from the launchers where E-field lines terminate only on the SWTL, the line is essentially non-radiating.

When uniformly surrounded by a medium such as air or vacuum, the characteristic impedance of the line in this region is nearly the same as the radiation impedance of free space; approximately 120 $\pi$ or about 377 ohms.

Figure 11:
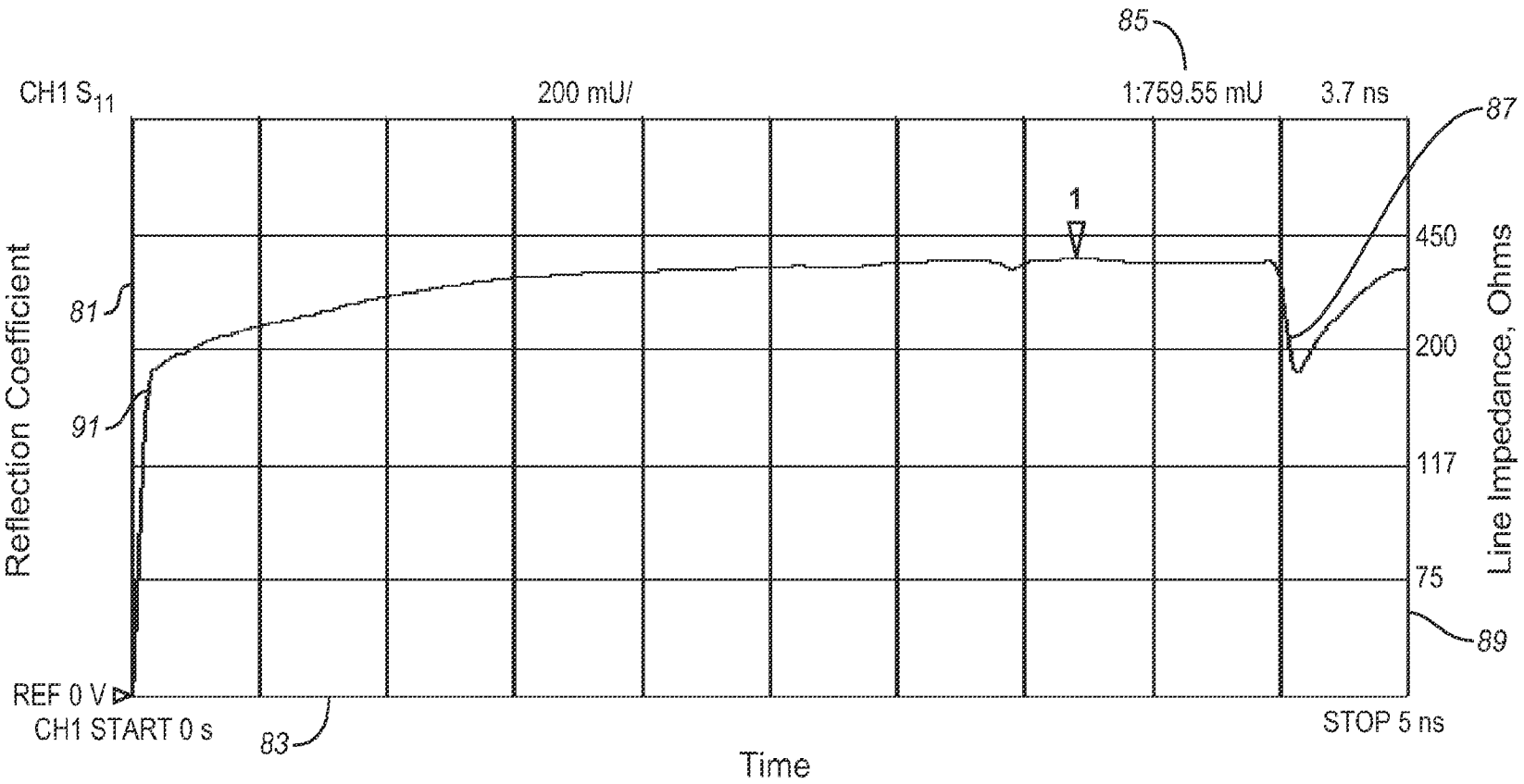
FIG. 11 is a graph showing a time domain reflection measurement of the SWTL system measured as in FIG. 7B, indicating the magnitude of the reflection coefficient and the corresponding SWTL line impedance as a function of time (distance) from the planar mode converter.

FIG. 11 shows a measurement of the characteristic impedance of a SWTL system as a function of line position relative to a launcher. The measurement was made in the frequency domain of the system measured in FIG. 7B with a vector network analyzer; and the results were transformed to low pass step response in time domain. The vertical axis 81 measures the reflection coefficient, relative to a 50 ohm measurement environment, over the range of 0 to 1. The right vertical axis 89 is labeled with the value of line impedance in ohms corresponding to reflection coefficients of 0.2, 0.4, 0.6 and 0.8. The horizontal axis 83 is a time axis. The time shown is that for round-trip transit of the incident wave stimulus used to measure the impedance. This value is precisely twice the time required for the wave to travel from the launcher to a corresponding location on the line. Physically the line is 678 mm long, which is also the spacing between the two planar launchers. From this measurement the manner in which the line impedance increases with distance away from the launcher and approaches the free space impedance can be directly observed. The marker value 85 indicates a line impedance of approximately 366 ohms. The sudden discontinuity 87 at approximately 4.5 nanoseconds is at the position of the second launcher.

The non-radiating nature of this SWTL may be understood by considering the symmetry provided by the arrangement. Considered both radially and longitudinally, every E-field line is paired with another line equal in magnitude but opposite to it in direction. At a distance from the SWTL, the combined effects of these fields sum almost to zero. Due to this symmetry, at locations farther than a few wavelengths from the conductor there is negligible radiation. The finite conductivity of the conductor does produce some transmission attenuation and the E-field magnitude does decrease somewhat with distance so the longitudinal E-fields don't completely cancel. However, for good conductors such as silver, copper or aluminum, the effect is small and this SWTL exhibits very low attenuation and is substantially non-radiating.

Figure 4:
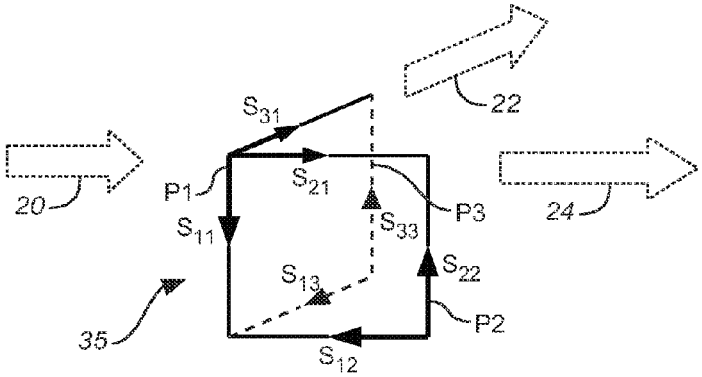
FIG. 4 is a schematic three-port S-Parameter representation of a mode converter.

FIG. 4 is a simplified three-port S-Parameter representation 35 of waves incident at 20 and emanating at 24 from the mode converter 14 of the first launcher shown in FIG. 1. Port 1 P1 represents the interface to the incident wave 20 at the launcher. $S_{11}$, $S_{12}$, $S_{21}$, and $S_{22}$ are the two-port S parameters when radiated coupling to the system is disregarded. Port 2 P2 represents the SWTL interface at the launcher. Port 3 P3 represents the launcher interface to waves 22 radiating into the enclosing medium 52 (which is shown in FIG. 1 and FIG. 3). A more complete three-port S-Parameter representation can be simplified by neglecting any incoming radiated wave at Port 3, which allows setting $S_{33}$ and $S_{13}$ to zero. This is the normal use case for the SWTL system, wherein power incident upon the system only radiates outward and away from the SWTL system and is not reflected back into the system by nearby structures.

It should be recognized that the system in FIG. 1 is symmetrical in nature and that a representation of power flow in the reverse direction; with incoming power incident on the second launcher 13 (again, either a mode converter alone or a mode converter and an adapter), traveling through the second mode converter 16 across the SWTL conductor 10 into the mode converter 14 of the first launcher and emanating from the adapter 12 of the first launcher, is equivalent to a representation having power flow in the forward direction since, in the absence of active devices or special magnetic materials such as ferrites, the law of reciprocity applies to this system and for the S-parameters shown, $S_{12}$ is equal to $S_{21}$ and $S_{13}$ as shown in FIG. 4 is equal to $S_{31}$. Except for the direction of wave propagation, the functions of the adapter 18 and mode converter 16 of the second launcher are the same as those of the first mode converter. Therefore the function of the SWTL system can be understood by analyzing it considering a wave incident upon only one end.

SWTL Central Conductor: The function of the SWTL central conductor used in the present invention is to guide a planar surface wave longitudinally along and through the region or space immediately around it. In a very general way, the operation of this SWTL can be thought of as a mirror of the of operation of fiber optic cable. Where fiber optic cable serves to propagate a wave by containing the wave energy within a dielectric, this SWTL line contains and propagates a wave in the region immediately around a central conductor.

As previously described, the wave is non-radiating due to symmetry. Power is lost from this system mainly through losses due to imperfect conductivity of the central conductor. These "ohmic losses" cause conversion of incident wave energy to heat and to a very slight degree, energy loss through radiation directly from the line. Because of the relatively high impedance of this SWTL, current in the conductor is lower and dissipative losses are low when compared to similar losses in conventional coaxial, micro-strip and most other common transmission line types.

A feature of this invention is that the diameter of the conductor may be large, even when compared to a wavelength of the transmitted wave. For previous transmission line types, such as coaxial cable once the central conductor circumference exceeds a wavelength of the propagating frequency higher order modes may become significant and reduce the usefulness of the transmission line. This invention has the advantage that both physically large conductors as well as conductors with circumferences large compared to a wavelength may be used to create a transmission line for transmitting energy over a very large range of wavelengths. Generally it is more difficult to directly initiate the surface wave onto a conductor having a circumference that approaches, equals or exceeds a wavelength of the propagating power but it is easy to initiate onto a smaller conductor and then to gradually taper the conductor size over a length to a much larger dimension. Sudden changes in conductor diameter can produce a discontinuity which results in reflection of the wave and also in conversion to radiation but as long as the tapering is done gradually, there is little penalty in the form of increased attenuation or radiation.

The central conductor need not be circular. As long as it is of relatively constant longitudinal cross section, the conductor only needs to have radial symmetry in order that the electric field lines emanating or entering it from opposite sides cancel. Radial uniformity is not required. Thus a cross section that is square, hexagonal or polygonal with any even number of sides will suffice. These sides do not have to be equal in dimension. A rectangle or a ribbon conductor can also be adequate. Variation is permissible in the structure of the SWTL conductor in the longitudinal direction, as long as any feature is relatively small compared to a wavelength of the transported wave. A conductor comprising a few or numerous smaller conductors twisted together, such as used in common power line conductors provides an excellent central conductor for a SWTL up to at least 10 GHz.

Figure 15:
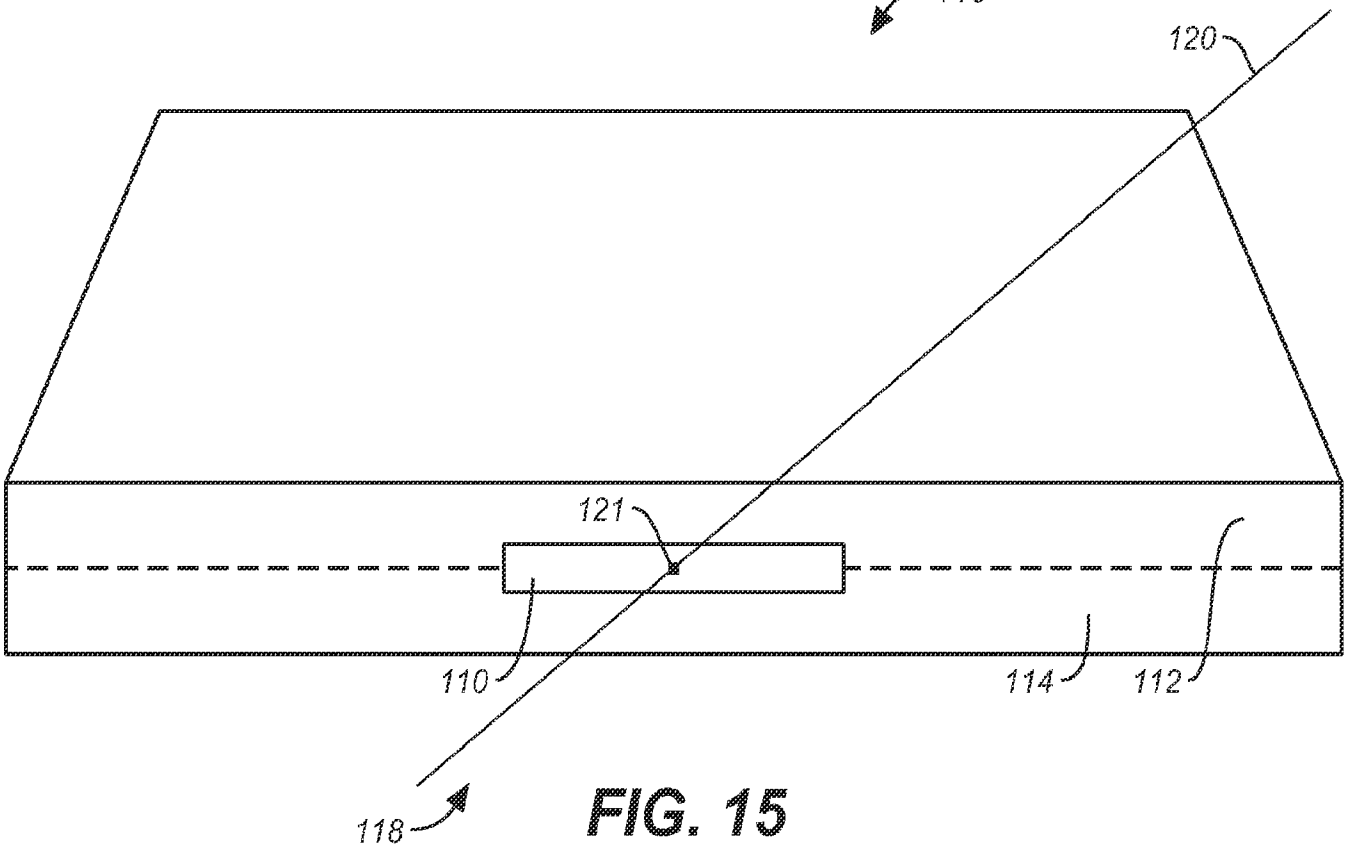
FIG. 15 is a cross-sectional end view showing a conductor enclosed by symmetrical but radially non-uniform dielectric material.

It should be recognized that the requisite symmetry in both radial and longitudinal directions can be provided by provision of suitable conductor, suitable dielectric and that neither radial nor longitudinal uniformity is necessary, only symmetry in both of these directions. Thus it is possible to use either a center conductor of either circular or equilateral polygonic cross section in conjunction with either a uniform or asymmetric dielectric medium surrounding the conductor and still obtain all the benefits of this invention. This requirement of symmetry apart from uniformity also applies to the mode converter. As an example, and referring now to FIG. 15, a ribbon shaped conductor 110 may be sandwiched horizontally between two sheets 112, 114 of low loss high dielectric material while the dielectric medium regions region 116 above dielectric sheet 112 and the dielectric medium 118 below the conductor 110 and the dielectric sheet 114 remains air. Such an arrangement does not have radial uniformity but would provide the requisite radial symmetry, shown by the line of symmetry 120 with respect to the conductor center 121 and through the radially non-uniform enclosing dielectric material. The mode converter associated with this type of line might also be non-uniform. In this example, it could be a section of conventional stripline transmission line utilizing the same dielectric sheeting surrounding the SWTL but including conventional ground planes at the upper surface of the upper dielectric sheet and the lower surface of the lower dielectric sheet. If the ground plane material were gradually removed in the region of the launcher where the transition between stripline transmission line and the single conductor SWTL occurs, the entire arrangement could exhibit simultaneous low attenuation and very broad bandwidth. This particular application of the inventive system might have particular value for millimeter wavelength and terahertz region applications where conventional transmission line types are difficult or ineffective.

Figure 13:
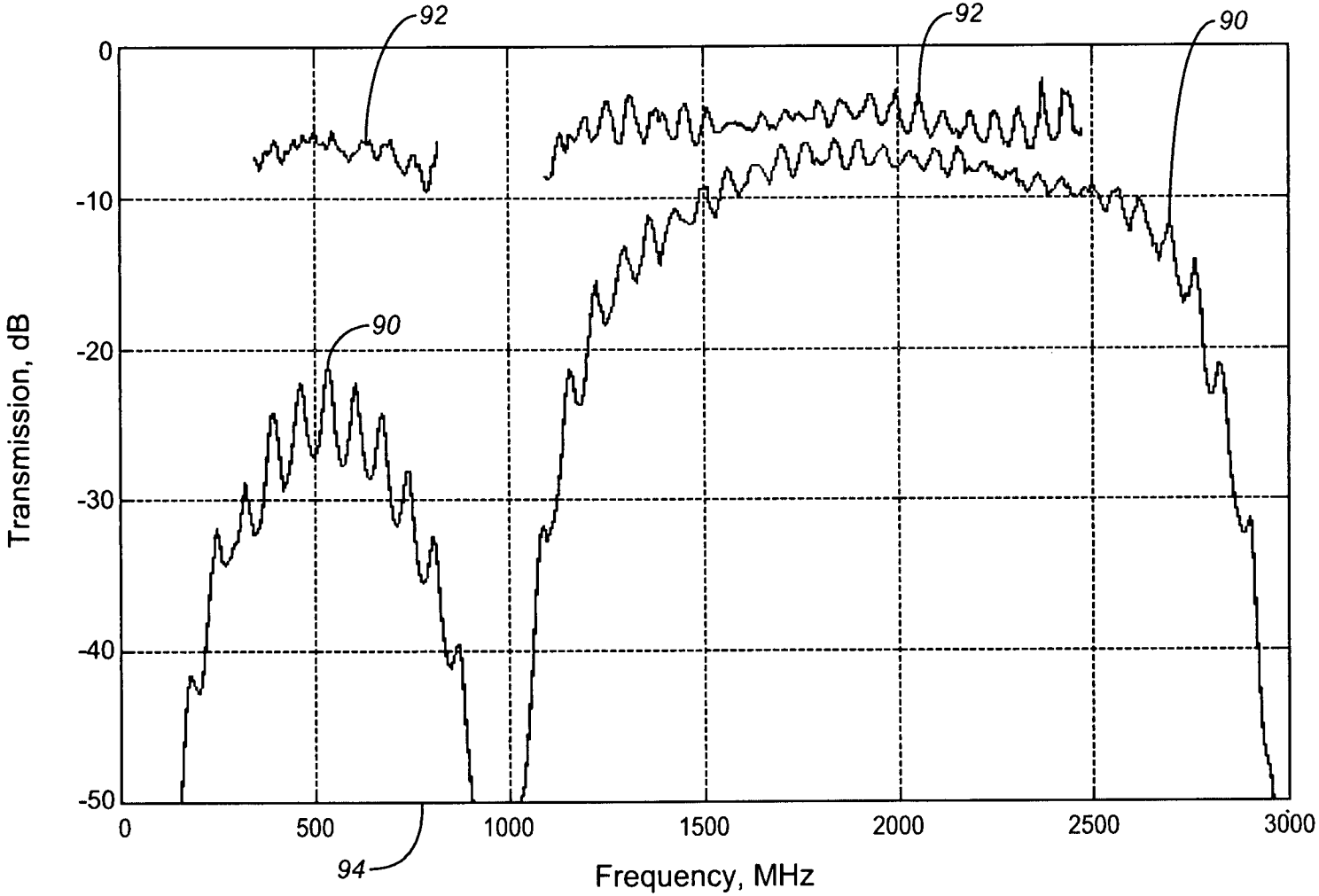
FIG. 13 is a graph of the inventive SWTL system using tapered launchers mounted at each end of approximately 60 feet of #4 stranded copper power line conductor.

The measurements shown in FIG. 13 plot $S_{21}$ 90 and GAmax 92 of a SWTL system using a pair of the slotted and tapered launchers described in U.S. Pat. No. 7,009,471, to the present invention, which patent is incorporated in its entirety by reference herein. The horizontal axis is frequency in MHz, and the vertical axis is transmission response in dB. As used herein, "GAmax" means the simultaneous conjugate match transmission parameter [S-Parameter Design, Application Note AN 154, Agilent Technologies].The adapter portion of this design provides band limited coupling and has approximately 1 dB of coupling loss at 2000 MHz. An incidental secondary response 94 at approximately 500 MHz exists. The coupling at this frequency is poor, but the plot of GAmax 92 shows the relatively constant underlying SWTL attenuation achievable with a launcher of convenient size.

Launchers: A launcher comprises a mode converter and may include an adapter.

Mode Converters: The mode converter serves to initiate propagation in the desired surface wave mode along the SWTL. The mode converter may also initiate propagation in other modes, including other transmission modes involving the SWTL conductor as well as radiation modes which radiate directly into the enclosing medium. Other transmission modes are generally not useful however for some applications it may be desirable to provide radiation from the launcher in order to produce a sort of "leaky transmission line." Deliberate unbalancing of the E-field symmetry can be used to accomplish this.

The mode converter can be thought of as a device that modifies the termination point of SWTL E-field lines. In the region far from the mode converter E-field lines terminate along the SWTL conductor while within the launcher they terminate in a manner so as to return current to the adapter, conventional transmission line or antenna type which is connected to the launcher.

Considering the electric field lines shown in FIG. 3 and presuming this planar mode converter 14 to have a small clearance hole 46 through which the SWTL center conductor passes in a coaxial manner, the region in the hole and to the left of the mode converter can be a coaxial transmission line.

In this arrangement, the center conductor, in combination with the conductive material on the inside edge of the hole 46, may be considered a conventional coaxial transmission line 31. In the region, field lines emanating from the coaxial center conductor all terminate in the outer conductor of that coaxial line. Current flow on the center conductor is equal in magnitude and opposite in polarity to current along the outer conductor. The electric field lines emanate at right angles to the direction of power flow within the coaxial line and also at right angles to both the central and outer conductor surfaces.

In the region far to the right of the mode converter, the electric field lines which emanate from the SWTL center conductor all terminate at different location along that same conductor. The mode converter is the structure intermediate between these two regions which provides a transition between these two different conditions.

It is useful to recognize that the presence of a mode converter reduces the impedance of the SWTL near the mode converter. As previously described and shown by the measurement of FIG. 11, in regions distant from a launcher, the impedance of the line is essentially identical to that of an unguided wave propagating within the same enclosing medium. As the line approaches the launcher, some of the E-field lines 44 (FIG. 3) terminate in the launcher instead of on the SWTL conductor. This causes the capacitance per unit length on the SWTL to increase and the SWTL impedance to decrease accordingly. SWTL impedance may decrease from about 376 ohms in regions that are at least several hundred times the conductor diameter away from the mode converter to less than 200 ohms in the region close to the conductive material of the mode converter.

There is a very large variety of structures which may be used for the mode converter function. When it is desirable to minimize coupling to a radiating mode polarized at right angles to the SWTL, mode converters will be likely to have radial symmetry. This means that their shape can be created by revolving a two-dimensional structure around the axis of the SWTL conductor. Other possibilities exist but this is generally the simplest way to maintain electric field symmetry and thereby minimize radiation polarized at right angles to the SWTL.

The fundamental function of the mode converter can be accomplished using a variety of shapes and materials including both conductors and dielectrics.

In considering alternative structures, fabricated primarily from conductive material, it is useful to consider the flare half-angle of the mode converter. This results in three general types, depicted in FIGS. 5A, 5B and 5C, respectively. These views schematically show a general class of converters and do not preclude special longitudinal shaping of the mode converter. Thus, there may be several sub-types of each of these general types, including linear taper, exponential taper, special curvature at the edge of the conductive material, and so forth.

Figure 5A:
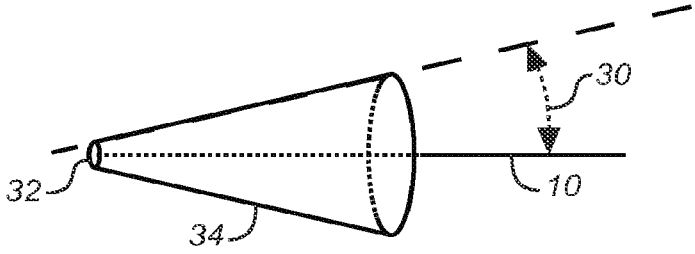
FIG. 5A is a schematic view of a "horn" type mode converter with a flare half-angle between zero and 90 degrees.

"Horn" Mode Converter with Flare Half-Angle between zero and 90 degrees: Referring first to FIG. 5A, there is shown a mode converter constructed so as to have a flare half-angle 30 from zero to 90 degrees. Converters having flare half-angles between zero and ninety degrees are of the flared horn variety 34. This is the type of launcher used in the prior art for G-Line. That art included both linear and special tapers of the basic horn shape.

For this type of mode converter, at least part of the adaptive function is performed within the tapered portion of the horn. This is because the impedance of the line within the horn is decreasing at the same time the diameter of the horn decreases. The result is a length of transmission line with tapered impedance, positioned between the open end of the horn and the connection point.

Figure 7A:
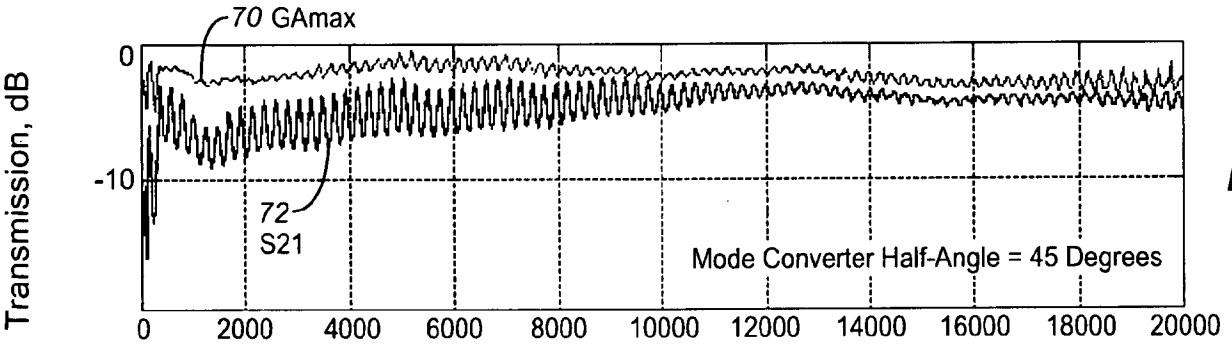
FIG. 7A is a graph showing a transmission measurement over the frequency range of 130 MHz to 20,000 MHz of a 678 mm length #24 gauge bare copper SWTL conductor with 68 mm diameter mode converters each having a 45 degree flare angle, wherein the lower plot is of $S_{21}$ and the upper plot is of GAmax.

Measurements of a horn mode converter with a mode converter half angle of 45 degrees are shown in FIG. 7A, which is a graph showing a transmission measurement in dB over the frequency range of 130 MHz to 20,000 MHz of a 678 mm length #24 gauge bare copper SWTL with 68 mm diameter horn mode converters each having a 45 degree flare angle, wherein the lower plot 72 shows $S_{21}$ and the upper plot 70 shows GAmax.

Figure 5B:
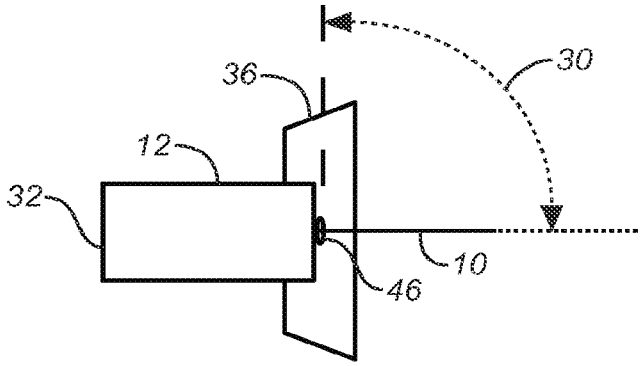
FIG. 5B is a schematic view of a planar type mode converter with a flare half-angle of 90 degrees.

Planar Mode Converter with Flare Half-Angle of 90 degrees: Mode converters with flare half-angles 30 of ninety degrees are planar mode converters 36, as shown in FIG. 5B. Launchers made with this type of mode converter have well defined measurement planes. These converters are perhaps the simplest type to measure, fabricate and also the simplest to analyze. These may also be the most practical type of mode converter for use at low frequencies. Below 30 MHz, the earth itself can serve as the plane from which to launch a wave onto a SWTL conductor. The conductor might be a self supporting vertical structure or suspended vertically and supported by a balloon, kite or other lifting device.

Figure 6:
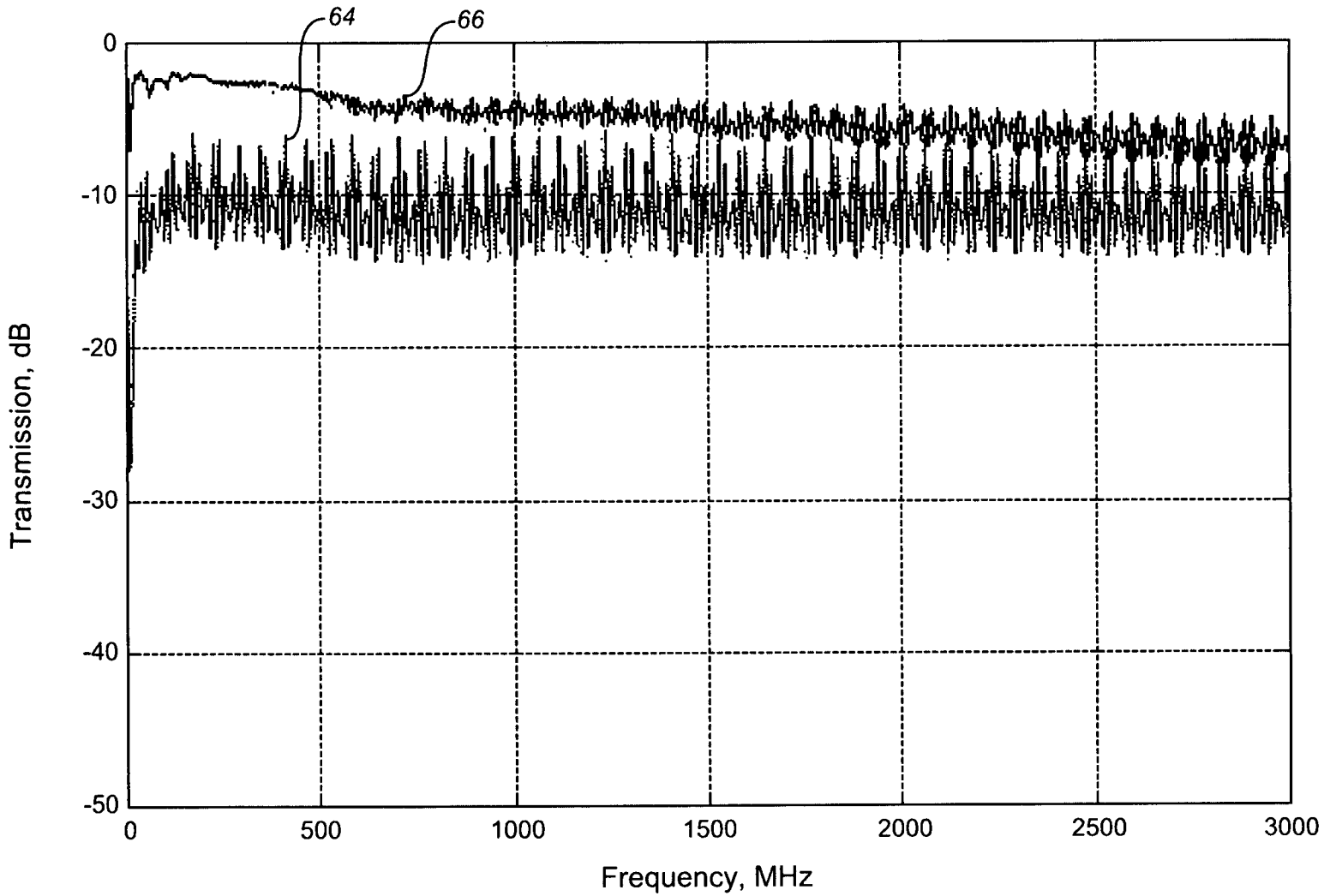
FIG. 6 is a graph showing a transmission measurement over 29 feet 8 inches of #24 gauge bare copper wire SWTL conductor with 2-foot diameter planar mode converters over the frequency range of 0.3 MHz to 3000 MHz, wherein the lower plot is of $S_{21}$ and the upper plot is of GAmax.
Figure 7B:
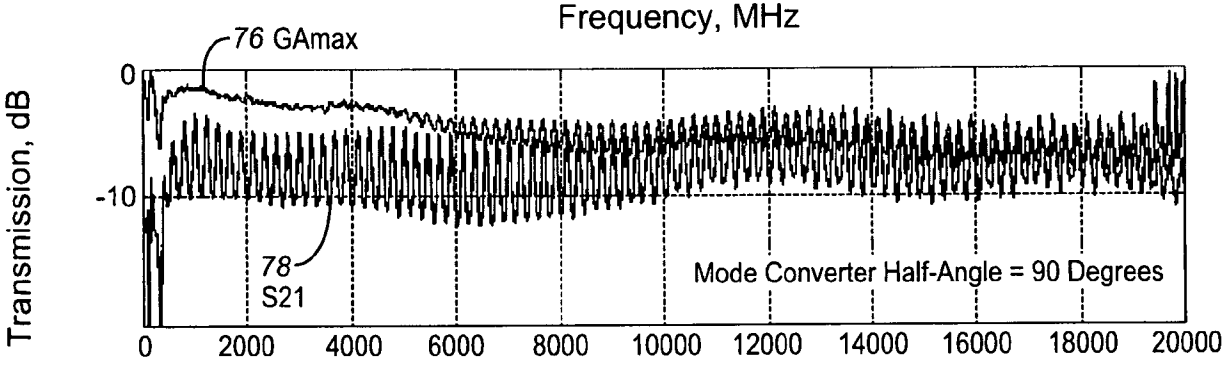
FIG. 7B is a graph showing a transmission measurement over the frequency range of 130 MHz to 20,000 MHz of a 678 mm length #24 gauge bare copper SWTL with 68 mm diameter planar mode converters each having a 90 degree flare angle, wherein the lower plot is of $S_{21}$ and the upper plot is of GAmax.

FIG. 7B shows a transmission measurement in dB over the frequency range of 130 MHz to 20,000 MHz of a 678 mm length #24 gauge bare copper SWTL conductor with 68 mm diameter planar mode converters each having a 90 degree mode converter half angle. The lower plot 78 shows $S_{21}$ and the upper plot 76 shows GAmax. Other measurements of planar mode converters are shown in FIG. 6 and FIG. 11. Compared to the other classes of mode converters, simple converters in this class often show the greatest re-reflection of the propagated wave as compared to the other two types. This is generally evidenced by greater ripple in the S parameter measurement than for other mode converter types.

Figure 5C:
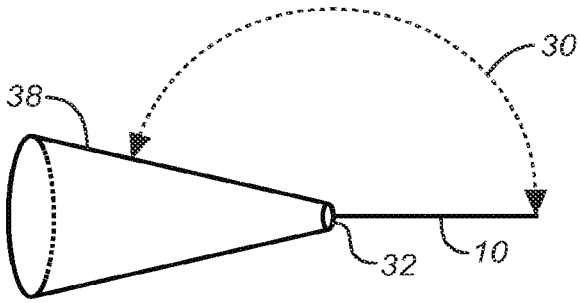
FIG. 5C is a schematic view showing a "reverse-horn" type mode converter with a flare half-angle between 90 and 180 degrees.

"Reverse Horn" Mode Converter with Flare Half-Angle between 90 degrees and 180 degrees: Mode converters with flare half-angles 30 greater than ninety degrees and less than 180 degrees are "reverse horn" converters 38, as shown in FIG. 5C. This type of converter generally shows a lesser degree of re-reflection and slightly less conversion to radiating mode than do the other two types. Radiation levels equating to approximately ten percent (10%) of the incident power at the launcher have been measured. However for this type of converter part of the impinging surface wave may continue past the launcher. While this generally results in reduced re-reflection, as evident in FIG. 7C as compared to FIGS. 7A or 7B, it may result in increased radiation from lines, connections or other structures behind the launcher.

Figure 7C:
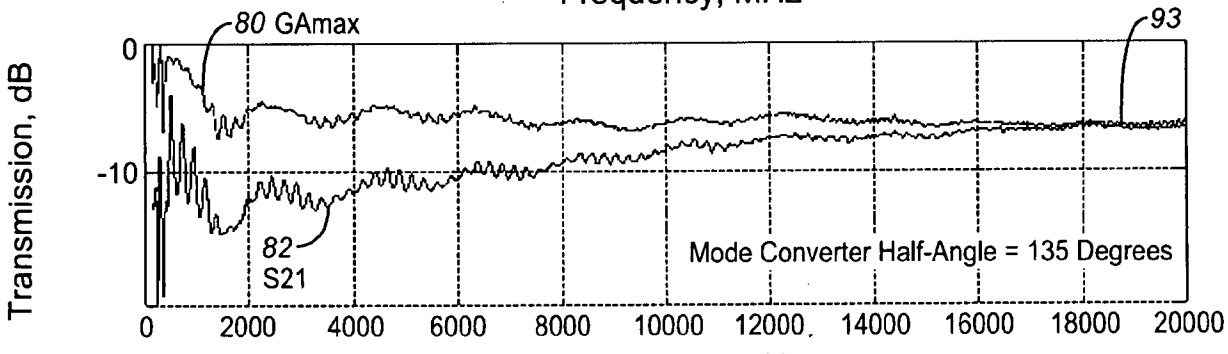
FIG. 7C is a graph showing a transmission measurement over the frequency range of 130 MHz to 20,000 MHz of a 678 mm length #24 gauge bare copper SWTL conductor with 68 mm diameter mode converters each having a 135 degree flare angle, wherein the lower plot is of $S_{21}$ and the upper plot is of GAmax.

FIG. 7C is a graph showing a transmission measurement in dB with a mode converter half angle of 135 degrees over the frequency range of 130 MHz to 20,000 MHz of a 678 mm length #24 gauge bare copper SWTL conductor with 68 mm diameter reverse horn mode converters each having a 135 degree flare angle. The lower plot 82 shows $S_{21}$ and the upper plot 80 shows GAmax.

For all three of these radially symmetric mode converter types, the signal converted to radiation 22, 26 away from the line (FIG. 1) is primarily linearly polarized with the polarization parallel to the SWTL conductor. Axial ratios of greater than 20 dB are common for radiation from all three types.

Adapter: The adapter 12 portion of the launcher serves to couple the mode converter to a conventional transmission line type or antenna. For many launchers, the mode converter-interface is a coaxial connection and the adapter essentially converts this to the impedance and connection type desired at the launcher input 32, in each of FIGS. 2A, 2B, 5A, 5B, 5C, 8B, and 10.

Figure 2A:
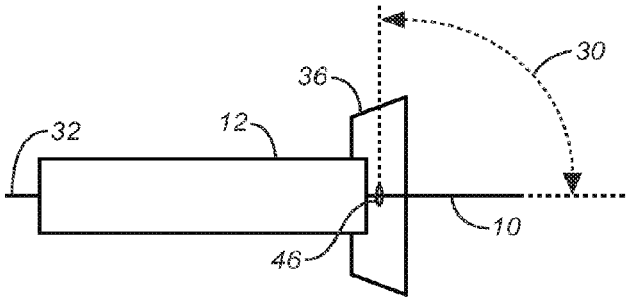
FIG. 2A is a schematic view showing a generic impedance matching and transmission type adapter combined with a planar mode converter for launching a surface wave.

The impedance of the connection at the mode converter tends to be relatively high compared to many conventional connector and transmission line types. If broadband functionality of the mode converter is required, the adapter 12 may be called on to simultaneously convert from the mode converter's connection and also to provide broadband impedance matching to the impedance and type of an external connector 32 as depicted in FIG. 2A. Transmission line adapters and impedance matching of this type are problems commonly solved in the art. At higher RF and microwave frequencies, stepped transmission line matching networks or Chebyshev taper transmission line transformers may be used. At lower frequencies lumped elements may be substituted.

Figure 2B:
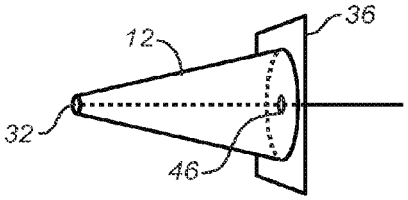
FIG. 2B is a schematic view of a mode converter as in FIG. 2A, but using a tapered coaxial line as an impedance matching device.

FIG. 2A and FIG. 2B depict two types of adapters, including in FIG. 2B the impedance matching performed by using a tapered coaxial transmission line 12. The arrangement shown in FIG. 2B serves to separate the impedance transformation function of a tapered coaxial adapter 12 from its use as a mode converter. The combined usage is shown in FIG. 5A. In each instance, the launcher 36 is of a planer type and has a small central hole 46 through which the SWTL central conductor 10 may pass.

Measurement of an Example Embodiment: FIG. 6 is an error corrected two-port S-parameter measurement of an embodiment of the inventive SWTL system utilizing two identical launchers with planar mode converters similar to those shown in FIG. 5B. Measurement axes for this plot are the same as for FIG. 13, discussed above. Thus, the horizontal axis is frequency in MHz, and the vertical axis is transmission response in dB. These mode converters have a flare half-angle 30 of ninety degrees. These particular launchers comprise only a mode converter and do not incorporate any additional impedance matching or adaptation. Connection to the mode converter is by way of coaxial transmission line 32.

Each launcher was fabricated by cutting the corners off a 2 foot square wood sheet to form a hexagon. Aluminum foil was affixed to one surface of the wood hexagon and a single SMA connector was mounted at the center of a small aluminum reinforcing plate with the connector center pin protruding above the plane of the aluminum foil. The selection of a hexagonal rather than a circular shape was out of convenience and is insignificant to this measurement. A SWTL conductor consisting of 29 feet 8 inches of bare #24 (0.02" diameter) copper wire was soldered to the center pin of each SMA connector. The two launchers were separated a distance of about 29 feet 8 inches (slightly more than 9 meters) so as to cause the copper wire to become taut. The entire system was situated so as to maintain at least 2 feet of clearance between the copper conductor and any other objects outside of the system.

Two plots are shown in FIG. 6. The lower plot 64 is of $S_{21}$ and the upper plot 66 is of GAmax. These measurements were made at 201 frequency points, evenly distributed between 0.3 MHz and 3000 MHz. $S_{21}$ is the error corrected transmission response measured at the SMA connectors with a vector network analyzer using a 50 ohm reference impedance and calibrated to the plane of the mode converter. GAmax is calculated from the four measured two-port S-Parameters and serves to remove the measured effects of the considerable impedance mismatch between the 50 ohm measurement system and the higher impedances presented by the SWTL system.

The plots shown in FIG. 6 demonstrate the very large frequency range possible with this SWTL system. Although the diameter of the mode converter was only 24 inches, relatively uniform operation of the system was available from about 25 MHz to beyond 3 GHz. Other measurements of this same system show GAmax having less than 10 dB of loss from below 10 MHz to above 10 GHz.

At very low frequencies where the diameter of the mode converter is less than approximately 4 percent of a wavelength, some of the E-field lines "wrap around" the mode converter and terminate on the feed line and other structures not intentionally part of the system. At these lower frequencies the input impedance of the launcher rises and becomes more difficult to efficiently match. Even so, mode converters of maximum dimension as small as two percent (2%) of a wavelength at the propagating wavelength can be effective.

The travel time measured was 29.025 nanoseconds. The physical length of the conductor was measured to be 28.52 feet (8.69 meters). These measurements indicate a wave velocity of $2.995\times10^8$ meters/sec which is within 0.07 percent (0.07%) of a calculated value for the speed of light in air and well within the uncertainty of this measurement.

$S_{21}$ and GAmax measured this way include the combined effects of both SWTL line loss and radiation loss from the system. In order to separate line loss from radiation loss and to determine the attenuation of the SWTL line alone, a corner reflector type reference antenna was used to measure the radiated field in the vicinity of the launcher at 1.8 GHz. This measurement is represented by the magnitude of $S_{31}$ in FIG. 4. To do this, the previous VNA connection at the SMA connector of the second launcher was moved to the reference antenna. The SMA connector at the second launcher was terminated with a 50 ohm load. The reference antenna was placed twelve inches away from the first launcher, this distance having been previously determined to be great enough to be in the far-fields of both the reference antenna and the launcher. The reference antenna polarization was aligned to be parallel with the SWTL conductor and the network analyzer was used to locate and to measure the maximum magnitude of the transmitted signal. Free space path loss at 1.8 GHz was calculated for the SWTL-to-antenna distance and using the known gain of the reference antenna and assuming the effective gain of the radiating element of the launcher to be the same as a dipole, or approximately 2.1 dB relative to an isotropic antenna, the coupling factor to the radiating mode was determined. This value was approximately −8 dB indicating that about sixteen percent (16%) of the power incident to port 1 was converted to a radiating mode and radiated away from the first launcher into space.

Figure 8A:
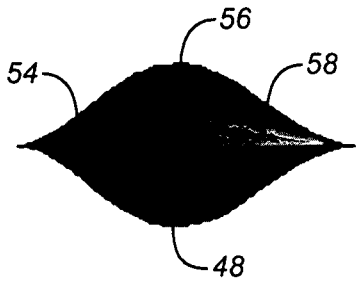
FIG. 8A is a schematic view showing a dielectric compensator for use with mode converters to reduce conversion to radiation and to improve impedance matching.
Figure 8B:
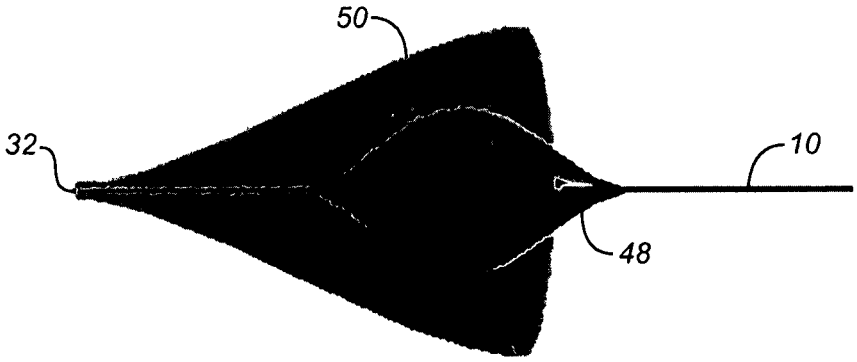
FIG. 8B is a schematic view showing a dielectric compensator as in FIG. 8A, positioned inside a specially tapered horn type mode converter.

Minimization of Radiation from the Mode Converter: The radiation away from the mode converter may be reduced by adding a compensator 48, as shown in FIG. 8A and FIG. 8B, made from dielectric material and located on the SWTL conductor near the mode converter 50 (FIG. 8B). An effect of this device is to reduce the sudden discontinuity of line impedance and increase symmetry of the E-fields in the region close to the mode converter.

The main purpose of this compensator is to expand the transition region of the mode converter in such a way as to increase symmetry of the E-field. This increased symmetry reduces radiation and increases transmission between the launcher and the SWTL surface wave.

The function of the dielectric to reduce radiation can be understood by considering a wave uniformly propagating along the SWTL conductor toward a launcher which incorporates a compensator as in FIG. 8B. As the wave impinges on the front portion 58 (FIG. 8A) of the specially tapered dielectric compensator 48, the electric fields tend to be concentrated within the dielectric and the extent of the fields beyond the compensator is reduced. As the wave proceeds in this direction, at the widest part 56 (FIG. 8A) (e.g., the mid section) of the compensator a majority of the wave is propagating entirely inside the dielectric. The line impedance in this region is considerably reduced with respect to the impedance in the region of uniform propagation beyond the dielectric and far from the launcher. As the wave continues toward the mode converter, the diameter of tapered portion 54 is reduced or the dielectric constant of the compensator is changed in such a way that in concert with the effects of the mode converter produces a constant or gradually tapering line impedance.

The dielectric compensator should be chosen to have a length of at least one half wavelength at the lowest frequency of use and should have a diameter and dielectric constant chosen to allow a majority of the wave to be encompassed in the region of its widest diameter 56. In one or both of the tapered regions 58, 54 the physical taper, dielectric constant or both may be adjusted to provide a Chebyshev or other desired taper to optimize compensation over a broad range of frequencies while requiring a minimum of dielectric material. Generally a dielectric material with low loss tangent, such as REXOLITE® or TEFLON®, should be used for best performance. [REXOLITE® is a registered trademark of C-LEC Plastics, Inc., of Philadelphia, Pa., and as used herein, the term shall mean a cross-linked polystyrene microwave plastic made by the trademark owner. TEFLON® is a registered trademark of E. I. Du Pont de Nemours and Company, and as used herein, the term shall mean polytetrafluoroethylene or polytetrafluoroethene (PTFE).]

Similarly, the taper of the line impedance in the region 54 from the region of maximum diameter of the compensator to the end of compensator nearest the launcher may be arranged by modifying the taper of the dielectric, the dielectric constant of the material, or the taper or shape of the mode converter if the mode converter is of a non-planar class.

Efforts taken to reduce the extent of the field near the mode converter in order to reduce impedance discontinuity and to increase E-field symmetry may also serve to reduce the minimum frequency at which the mode converter can operate.

Figure 12:
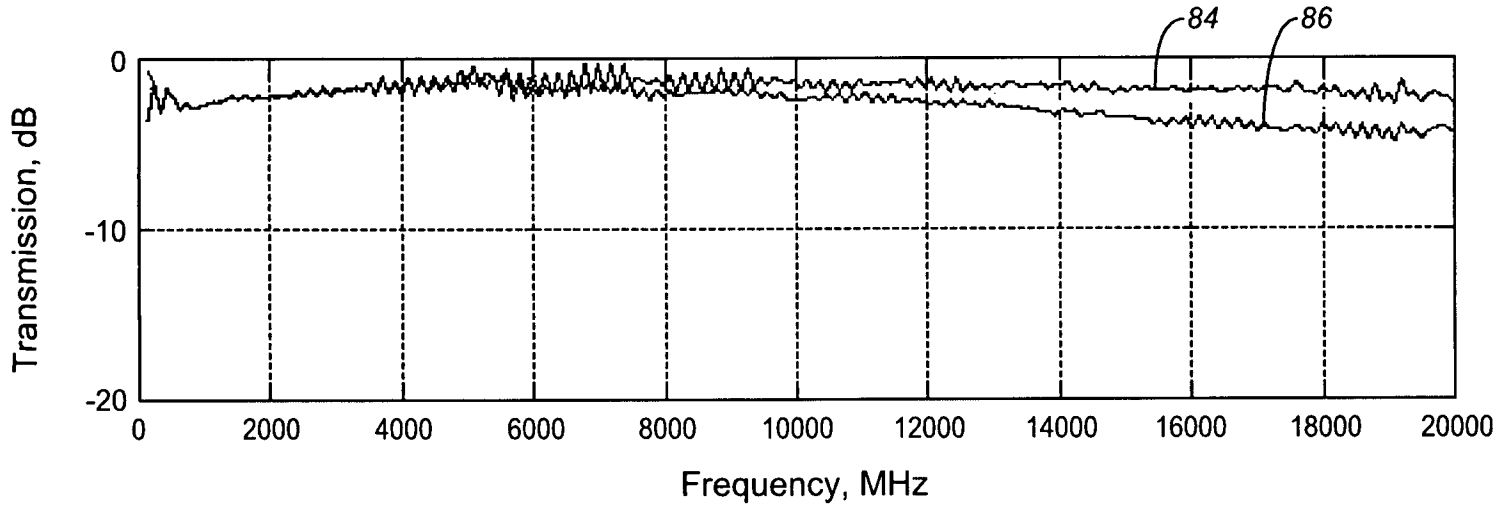
FIG. 12 is a graph representing GAmax on a SWTL system with and without compensated launchers.

Plots showing the performance of launchers with compensation 84 and without compensation 86 are shown in FIG. 12. Measurement axes are the same as for FIGS. 6 and 13, discussed above. Here a SWTL system similar to the one measured in FIG. 7A is measured and GAmax is calculated and plotted twice, once before the addition of a crude polyethylene compensator (shown in plot line 84), and again after the addition of the compensator (shown in plot line 86). The compensators used for this were approximately 35 mm long and 6 mm wide at the mid section (56 in FIG. 8A). Each was tapered approximately linearly down to a small diameter "nose" at each end. Each compensator was placed within the flared section of a mode converter between the horn mouth and about 20 mm from the SMA connector. Its position was adjusted to provide the maximum transmission. As can be seen, the volume of dielectric was too small to provide improvement across the entire 0.13-20 GHz frequency range, but above about 14 GHz very significant improvement is evident producing less than 1.5 dB end to end loss, for the entire SWTL system.

It should be noted that at shorter wavelengths mode converters may provide compensation or impedance matching as part of their nature. This is because at wavelengths where the region of very rapid SWTL line impedance change 91 (FIG. 11) is one quarter wavelength of the propagating wave or longer, reasonably good impedance matching may occur. Evidence of this can be seen by comparing the $S_{21}$ and GAmax plots of FIG. 7C in the region 93 above 18 GHz (FIG. 7C). In this region the two plots can be seen to be nearly identical. This indicates that the impedance match is relatively good even without any additional dielectric compensation.

Although a single extremely wideband measurement of an exemplary system is not herein provided, the combination of excellent operation at high frequencies, where the SWTL conductor circumference becomes comparatively large in relation to wavelength, along with the ability of the system to operate at low frequencies using a launcher having a maximum dimension measured in a plane at right angles with respect to the central conductor no larger than about 2% of the propagation energy wavelength, the system can provide continuous and low attenuation, broadband transmission over more than three decades of frequency range from a single SWTL system. At the same, launchers which are small compared to the wavelength of the lowest frequency signal may be very large compared to the wavelength of the highest frequency signal being transmitted through the system. These dimensions may be very small or very large in a physical sense as well, depending upon the particular wavelengths being considered.

In the same manner that launcher size, measured both in the plane at right angles to the conductor as well as in a longitudinal direction along the conductor, may be either large or small either in an absolute physical sense or when considered relative to a wavelength of the propagating signal, the conductor size, measured either in diameter or circumference, may also be either very large or very small. Launcher dimension measured longitudinally along the conductor may be essentially zero for the case of a planar type mode converter.

An inventive system, similar to the exemplary system above, having launchers with a two-foot diameter, and having coverage of from below 10 MHz to above 10 GHz, would achieve good performance to as high as 100 GHz and above. In fact, with suitable manufacturing precision and connectors, the system could operate efficiently in a four decade frequency range.

Deliberate Conversion to Radiating Mode In the Mode Converters: It is also possible to increase the degree of radiation from the mode converter by reducing the E-field symmetry in the region near the mode converter. This can be done by configuring dielectric devices to increase the rate of impedance change. Radiation with polarization at right angles to the SWTL conductor may be increased by reducing the radial symmetry of the mode converter. The symmetry can be reduced by notching a radial segment away from the material used to construct the mode converter.

Thus, linearly polarized radiation away from the mode converter parallel to the SWTL conductor, orthogonal to the SWTL conductor or a combination of these two can be obtained.

Figure 9A:
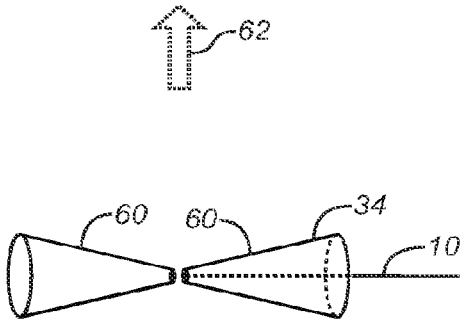
FIG. 9A is a schematic representation of an integrated SWTL mode converter and bi-conical antenna providing maximum coupling between the SWTL and antenna.
Figure 9B:
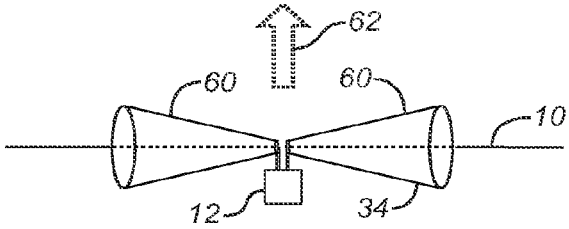
FIG. 9B is a schematic representation of an integrated SWTL mode converter and bi-conical antenna providing coupling between the SWTL and shared between an integrated antenna and a second mode converter coupling to a second SWTL.

Deliberate Conversion to Radiating Mode at the Adapter: In addition to adapters which convert to balanced, coaxial, micro-strip, co-planar waveguide, fin-line, waveguide or other common types of transmission line, some alternative embodiments tailored for use in specific applications may include an antenna to convert directly to radiated power 62 (FIGS. 9A and 9B). In addition to direct radiation from the mode converter that has already been mentioned, there are a many ways to accomplish radiation from the adapter.

FIG. 9B depicts an SWTL system used to feed an antenna system. The adapter 12 couples the mode converter interface type and mode converter impedance to the interface type and impedance of an antenna element 60. Antenna impedance may be such that no adapter is required to couple efficiently to a single SWTL as in FIG. 9A or an adapter may be used to provide power distribution wherein power from two different SWTLs is combined as shown in FIG. 9B.

Figure 10:
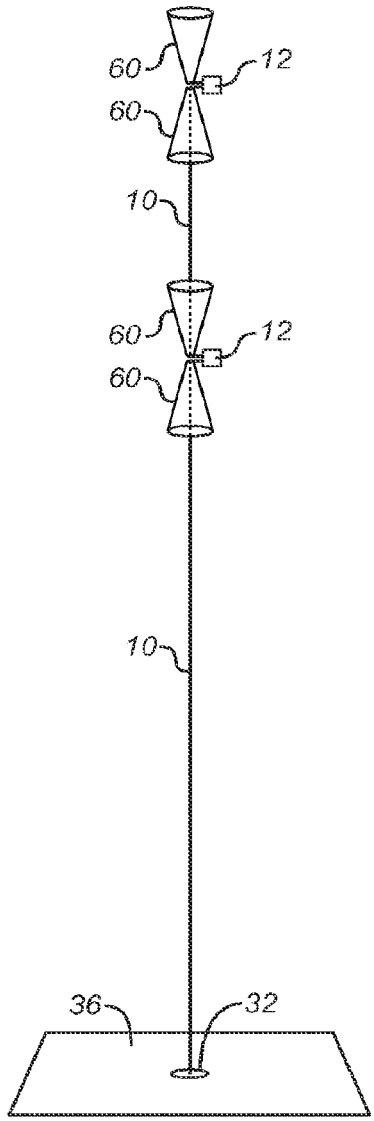
FIG. 10 is a schematic view showing a high altitude antenna system using the devices of FIGS. 9A and 9B, suitable for support by a balloon or other airborne support, exhibiting gain and directivity and fed by way of a ground mounted planar mode converter and integrated SWTL and tether.

FIG. 10 shows one possibility wherein a mode converter of the type shown in FIG. 5B is located on the earth end of a vertically suspended SWTL conductor and radiating adapters of the types shown in FIG. 9B are used together to create an antenna system which has additional gain and directivity. The relative magnitude and phase of the wave being presented to each antenna may be arranged by suitable adapter, shown in FIG. 9B as element 12, so as to provide the desired antenna system radiation pattern.

In these examples, the integration of bi-conical antenna elements 60 and a horn type mode converter 34 (FIGS. 9A and 9B) is a particularly attractive alternative because the terminal impedance of a bi-conical antenna tends to be relatively high and thus simpler impedance matching networks are required than might be the case for other antenna types. The antenna of FIG. 10 might be tethered by the SWTL conductor while being supported by an aerial supporting device such as a balloon or kite. This arrangement can produce a broadband directive antenna, located at considerable elevation above ground and ground clutter. Alternately, a discone antenna might be used in this application in place of the bi-conical antenna if a suitable plane reflector were provided, as is known in the art.

Because the SWTL system of this present invention can use bare wire, the resulting antenna and feed line system can be very lightweight and supported with inexpensive lifting devices. An antenna of the type shown in FIG. 9A, suitable for use from approximately 100 MHz to 2000 MHz, was constructed and lifted with a helium-filled metalized MYLAR® "party" balloon having a diameter of about 2 feet. The balloon and antenna assembly were tethered by a copper SWTL conductor and allowed to rise from 10 feet above ground level to 200 feet above ground level while the signal strength from a commercial VHF FM broadcast transmitter located approximately 100 miles distant was measured. An improvement of more than 30 dB was registered for this change in height. This general concept of using the SWTL system as light weight feed line for antenna systems could be extended for use from as low as 1 MHz to above 10 GHz. Such a system could provide greatly improved communications potential and increasing communications range as compared to a ground or near-ground antenna fed with conventional transmission lines. A great advantage of this application is in allowing heavy communications equipment to be located at ground level while inheriting the advantages of an antenna system located well above ground clutter, buildings, hills or other obstructions. Applications for this include battlefield communications, emergency communications, mobile telephone coverage extension and communications for mass media coverage special events located away from other communications alternatives.

An aerially supported SWTL system of this type might also be useful for powering devices at the top. Due to the low transmission loss and low weight, significant RF power can be transmitted to devices located at great elevation while supported by relatively small and inexpensive lifting devices. This capability might provide the economical possibility for rectification of RF energy transmitted from the ground end of the SWTL system in order to provide operating power for radio or television broadcast or relay, audio broadcast, lighting for advertising or other signage, or a source of ground illumination which could be located at great altitude and usable or accessible over a wide geographic area. Since significant power can be transmitted from the ground to the elevated device with relatively low loss, it could be possible to power an active lifting device for the SWTL system, such as an electric helicopter. In this use, the SWTL system might simultaneously transmit power to lift the apparatus, illuminate advertising signage or even operate a large screen display while also providing communications by way of one or more co-located antennas.

Another possible application of a launcher type which couples a SWTL to an antenna is for use at wavelengths in the sub-millimeter range. A possible instance of this sort of use has already been reported [*Metal wires for terahertz wave guiding*, K. Wang & D. Mittleman, letters to nature, *Nature*, Vol. 432, 18 Nov. 2004, p. 376]. Such an application is an example of the invention utilizing very large conductors. Though such conductors have diameters which can be a very large number of wavelengths at the propagating frequency, as long as sufficient symmetry is maintained, as previously detailed, good performance of the SWTL system can result. At very short wavelengths, considerable precision may be required to attain the best results. Nanotechnology methods and techniques may be beneficial in this regard. It may be possible to produce a single SWTL system that can operate effectively from below 10 MHz to well beyond 1000 GHz and perhaps even as far as infrared or optical wavelengths.

From the foregoing, it will be appreciated that the inventive system, in its most essential aspect, is a low attenuation surface wave transmission line system that includes, a bare and unconditioned conductor, by which is meant that conductor lacks dielectric or special conditioning, uniformly surrounded by at least one medium, typically air in the anticipated environment of use. A first launcher is provided for receiving an incident wave and propagating a surface wave longitudinally along and in the region immediately around the conductor. A second launcher is provided in a spaced apart relationship to the first launcher and is disposed on the conductor. In a preferred embodiment, the first and said second launchers have a maximum dimension no greater than 64 cm and transmit surface waves having a frequency less than 5 GHz.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A surface wave transmission line system, comprising:

a single conductor having a cross-sectional dimension;

a first launcher for receiving incident electromagnetic energy and propagating a surface wave longitudinally along and in the region immediately around said conductor; and a second launcher spaced apart from said first launcher on said conductor;

wherein when a surface wave is launched on said conductor, in regions removed from said first and second launchers at least several hundred times the greatest cross-sectional dimension of said conductor, all E-field lines emanating from said conductor terminate at E-field termination points located along said conductor;

wherein said conductor is radially symmetrical and has a generally uniform longitudinal cross section such that in regions far from said conductor, E-field lines emanating from or terminating onto said conductor from opposite sides cancel one another.

2. The system of claim 1, wherein the surface wave launched on said conductor is of a frequency between 50 MHz and 20 GHz.

3. The system of claim 1, wherein in operation the incident electromagnetic energy is directed to said first launcher via radiation through free space.

4. The system of claim 3, further including an antenna to convert the incident electromagnetic energy directly to radiated power.

5. The system of claim 4, wherein said antenna is tethered to said system and is supported aerially with an aerial supporting device.

6. The system of claim 1, wherein said conductor is bare and unconditioned, lacking dielectric or special conditioning.

7. The system of claim 1, further including at least one dielectric medium surrounding said conductor.

8. The system of claim 7, wherein said at least one dielectric medium is non-uniform radially.

9. The system of claim 8, wherein said conductor has a cross-sectional shape that is polygonal and has an even number of sides.

10. The system of claim 1, wherein said first and second launchers are mode converters and have a maximum dimension measured in a plane at right angles to said conductor which is greater than or equal to two percent (2%) of the wavelength of surface wave launched by said first launcher.

11. The system of claim 10, wherein in operation at least one of said mode converters modifies the termination points of the E-field lines along said conductor.

12. The system of claim 10, wherein in operation said mode converters initiate propagation of surface waves along said conductor.

13. The system of claim 10, further including a compensator for reducing radiation away from at least one of said mode converters.

14. The system of claim 13, wherein at least one of said first and second launchers further includes an adapter for coupling to a conventional transmission line type or antenna.

* * * * *